US006059667A

United States Patent [19]

Pinch

[11] Patent Number: 6,059,667

[45] Date of Patent: May 9, 2000

[54] PENDULUM-DRIVEN CHILD SWING

[75] Inventor: Daniel R. Pinch, Clermont, Fla.

[73] Assignee: Cosco, Inc., Columbus, Ind.

[21] Appl. No.: 09/218,436

[22] Filed: Dec. 22, 1998

[51] Int. Cl.[7] ..... A63G 9/16

[52] U.S. Cl. ..... 472/119; 297/273

[58] Field of Search ..... 472/119, 125; 297/273, 274, 275, 276, 277, 281, 260; 5/108, 109; 368/160, 165, 166

[56] References Cited

U.S. PATENT DOCUMENTS

| | | |
|---|---|---|
| 989,517 | 4/1911 | Turmelle . |
| 1,016,712 | 2/1912 | Schilling . |
| 1,505,117 | 8/1924 | Withun . |
| 1,702,190 | 2/1929 | Anello . |
| 2,024,855 | 12/1935 | Goetter . |
| 2,091,841 | 8/1937 | Warren . |
| 2,564,547 | 8/1951 | Schrougham . |
| 2,609,031 | 9/1952 | Puscas . |
| 2,617,247 | 11/1952 | Punzak . |
| 2,972,152 | 2/1961 | Vincent . |
| 3,146,985 | 9/1964 | Grudoski . |
| 3,290,874 | 12/1966 | Koplar . |
| 3,417,498 | 12/1968 | Anthony . |
| 3,434,279 | 3/1969 | Hancock et al. . |
| 3,486,321 | 12/1969 | Bodet . |
| 3,692,305 | 9/1972 | Allen . |
| 3,802,181 | 4/1974 | Marquis . |
| 3,842,450 | 10/1974 | Pad . |
| 3,883,136 | 5/1975 | Kim . |
| 4,150,820 | 4/1979 | Bochmann . |
| 4,211,401 | 7/1980 | Cunard . |
| 4,448,410 | 5/1984 | Kosoff . |
| 4,452,446 | 6/1984 | Saint . |
| 4,491,317 | 1/1985 | Bansal . |
| 4,616,824 | 10/1986 | Quinlan et al. . |
| 4,722,521 | 2/1988 | Hyde et al. . |
| 4,785,678 | 11/1988 | McGugan et al. . |
| 4,807,872 | 2/1989 | Spilman et al. . |
| 4,822,033 | 4/1989 | Kohus et al. . |
| 4,911,429 | 3/1990 | Ogbu . |
| 5,085,425 | 2/1992 | Collins et al. . |
| 5,139,462 | 8/1992 | Gabe . |
| 5,326,327 | 7/1994 | Stephens et al. . |
| 5,378,196 | 1/1995 | Pinch et al. . |
| 5,833,545 | 11/1998 | Pinch . |

*Primary Examiner*—Kien T. Nguyen
*Attorney, Agent, or Firm*—Barnes & Thornburg

[57] ABSTRACT

A swing assembly includes a support stand, a swing mounted on the support stand to swing back and forth along a swing arc, and a swing driver. The swing driver includes a drive belt coupled to the swing, a belt tensioner coupled to the drive belt to place the drive belt in tension, and a belt driver coupled to the drive belt. The belt driver moves the drive belt relative to the support stand while the drive belt remains in tension to apply force to the swing to sustain swinging movement of the swing along the swing arc. The drive belt includes a strap having a fixed end coupled to the support stand and a free end coupled to the belt tensioner. The drive belt has drive teeth that are appended to the strap and coupled to the belt driver.

42 Claims, 7 Drawing Sheets

PENDULUM-DRIVEN CHILD SWING

BACKGROUND AND SUMMARY OF THE INVENTION

The present invention relates to child swings, and particularly to a child swing having a swing mounted on a support stand for pendulum motion. More particularly, the present invention relates to a child swing having a swing driver that is energized by electricity to sustain swinging movement of the swing.

Any rigid body mounted so that it can swing in a vertical plane about some axis passing through it under the influence of gravity is called a physical pendulum. A swing seat mounted on a frame for swinging movement about a swing axis is an example of a physical pendulum because the swing seat can swing backward and forward along a swing arc like a pendulum in a grandfather's clock.

Pendulums such as swing seats swing along a swing arc back and forth between first and second extreme positions. "Amplitude" is understood to be the extent of angular movement of a pendulum measured from the first extreme position to the second extreme position.

The motion of a pendulum is periodic and oscillatory. Any motion that repeats itself in equal intervals of time is called periodic motion. A body in periodic motion that moves back and forth over the same path undergoes oscillatory motion. The "period" of motion of a pendulum is understood to be the interval of time required for the pendulum to complete a cycle and begin to repeat itself. A cycle is one complete round trip of motion (e.g., swinging movement of a pendulum from the first extreme position to the second extreme position and back to the first extreme position).

The period of any pendulum is a function of (1) gravity; (2) the distance between the center of gravity of the pendulum and the axis about which the pendulum swings, and (3) the amplitude of the pendulum (especially in circumstances where the pendulum amplitude is greater than a few degrees). The period of a pendulum is typically measured in seconds per cycle. It is important to understand that the period of a pendulum is independent of the mass of the pendulum.

The natural frequency of a pendulum is the number of cycles completed by the pendulum per unit time when the pendulum is displaced and then released. The natural frequency of a pendulum is also a function of the three factors noted above in the discussion about the period of a pendulum. The natural frequency of a pendulum is independent of the mass of the pendulum and is typically measured in cycles per second.

A pendulum would oscillate indefinitely if no frictional or wind-resistance forces acted on the pendulum. Actually, the amplitude of oscillation of a pendulum gradually decreases to zero as a result of friction and wind-resistance forces acting on the pendulum as it swings unless some oscillatory external force is applied to the pendulum. In some cases, in an attempt to sustain swinging movement of a pendulum, the pendulum is subjected to an oscillatory external force having a frequency that is different than the natural frequency of the pendulum. The response of the pendulum depends on the relation between the "forced" and natural frequency.

In accordance with the present invention, a swing assembly includes a support stand, a swing mounted on the support stand to swing back and forth along a swing arc, and a swing driver. The swing driver includes a drive belt coupled to the swing, a belt tensioner coupled to the drive belt to place the drive belt in tension, and a belt driver coupled to the drive belt. The belt driver moves the drive belt relative to the support stand while the drive belt remains in tension to apply force to the swing to sustain swinging movement of the swing along the swing arc. The drive belt includes a strap having a fixed end coupled to the support stand and a free end coupled to the belt tensioner. The drive belt has drive teeth that are appended to the strap and coupled to the belt driver.

In preferred embodiments, the swing includes a drive shaft mounted for rotation on the support stand. A swing seat frame and a drive member are both coupled to the drive shaft for conjoint rotation. The drive belt is coupled to the drive member. The drive member has a drive lever with a base end coupled to the drive shaft and a free end spaced apart from the base end. A lever wheel is mounted on the free end for rotation about an axis of rotation and the drive belt wraps around a portion of the lever wheel. The strap has a first side carrying the drive teeth and a second side providing a friction surface engaging the lever wheel.

The belt driver includes an electric motor, a motor shaft turned by the electric motor, and a drive gear carried on the motor shaft for rotation therewith. The drive teeth on the strap engage the drive gear.

The belt tensioner includes a belt support including a support base, a spring wheel rotatable about an axis of rotation relative to the support base, and a constant-force spring acting between the support base and the spring wheel. The belt tensioner is positioned to lie between the drive shaft and the lever wheel during rotation of the drive member about the axis of rotation.

The free end of the drive belt is coupled to the spring wheel to rotate with it about the axis of rotation. The spring wheel includes an outer wall engaging the drive belt and an inner wall defining a spring cavity. The constant-force spring is positioned to lie in the spring cavity. The constant-force spring includes a fixed end coupled to the support base and a free end coupled to the inner wall of the spring wheel.

Additional features of the invention will become apparent to those skilled in the art upon consideration of the following detailed description of the presently perceived best mode of carrying out the invention.

BRIEF DESCRIPTION OF THE DRAWINGS

The detailed description particularly refers to the accompanying figures in which.

DETAILED DESCRIPTION OF DRAWINGS

Figure 1:
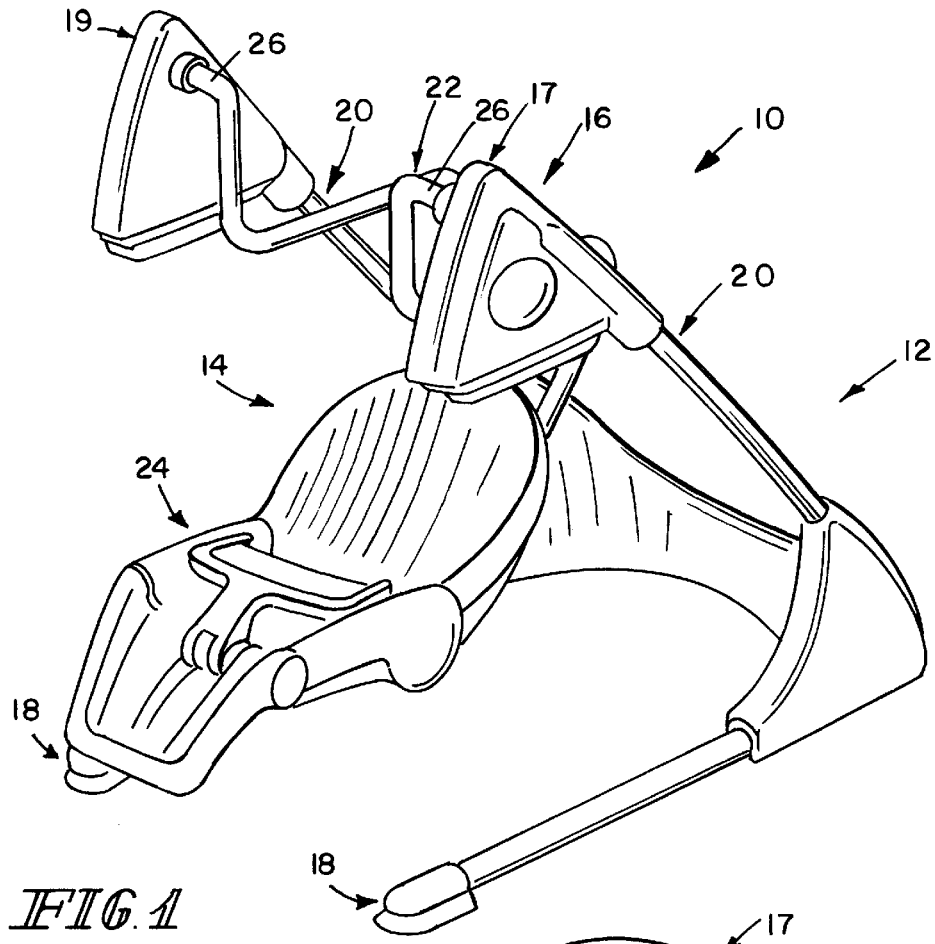
FIG. 1 is a perspective view of a swing including an automatic pendulum-drive system in accordance with the present invention and showing a support stand, a swing hanging from the support stand and carrying a swing seat, and a pair of generally triangular housings coupled to the support stand, one of the housings containing a swing driver configured to sustain swinging movement of the swing.

A swing assembly 10 includes a support stand 12, a swing 14 mounted on support stand 12 to swing back and forth in an arc with pendulum motion, and a swing driver 16 as shown, for example, in FIG. 1. Support stand 12 includes a pair of ground supports 18 and upwardly extending support arms 20 for supporting swing 14. Swing 14 includes a swing frame 22 coupled to a seat 24 that is configured to retain a child (not shown) during swinging motion. Support stand 12 and swing 14 are configured so the center of gravity of swing assembly 10 remains between ground supports 18 during swinging motion so that swing assembly 10 remains on the ground.

Swing driver 16 is adapted to apply force to swing 14 to sustain swinging movement along its swing arc. Swing driver 16 includes several components contained within a housing 17 coupled to one of the support arms 20 of support stand 12 as shown in FIGS. 2–9. A similar but empty housing 19 is coupled to the other of the support arms 20.

Figure 2:
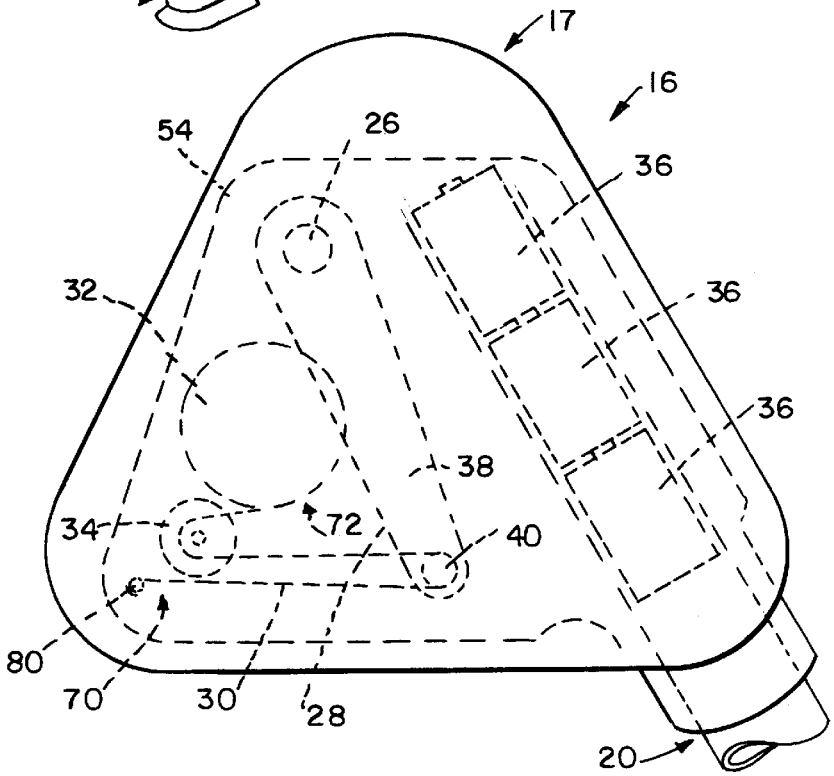
FIG. 2 is an enlarged view of a portion of FIG. 1 (similar to FIG. 6) showing the housing containing the swing driver, and showing, in phantom, four batteries on the right and, on the left, a pivotable drive member, a large-diameter belt tensioner, a small-diameter belt driver under the belt tensioner, and a drive belt lying in a somewhat S-shaped configuration and having a lower end coupled to the housing, an upper end coupled to the belt tensioner, and a middle portion engaging the belt driver and a lowest end of the drive lever.
Figure 3:
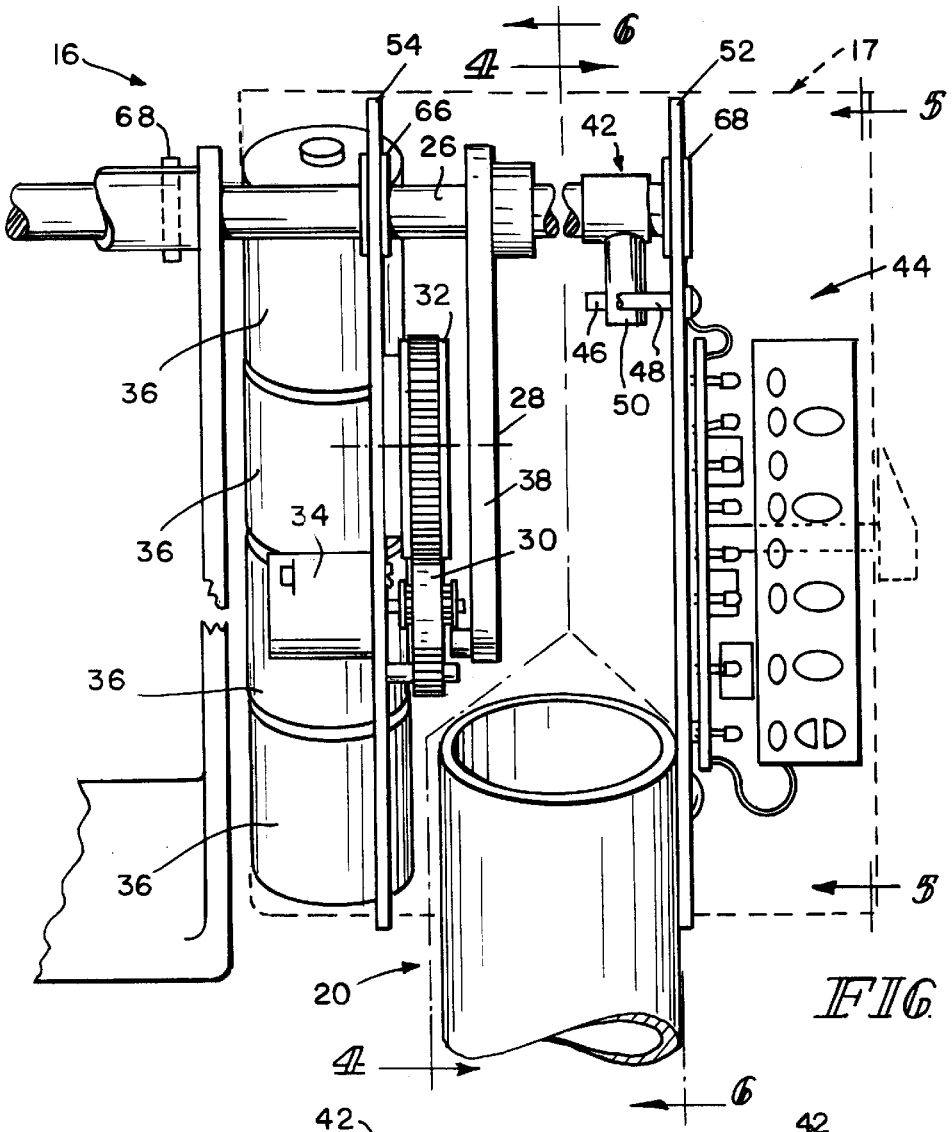
FIG. 3 is a front end view of various components included in the swing driver housing (with the housing itself shown in phantom) of FIG. 2 showing various swing driver components on the left and, on the right, a slip switch coupled to the drive shaft, and an electronic control system circuit board for using the slip switch to control the belt driver.
Figure 6:
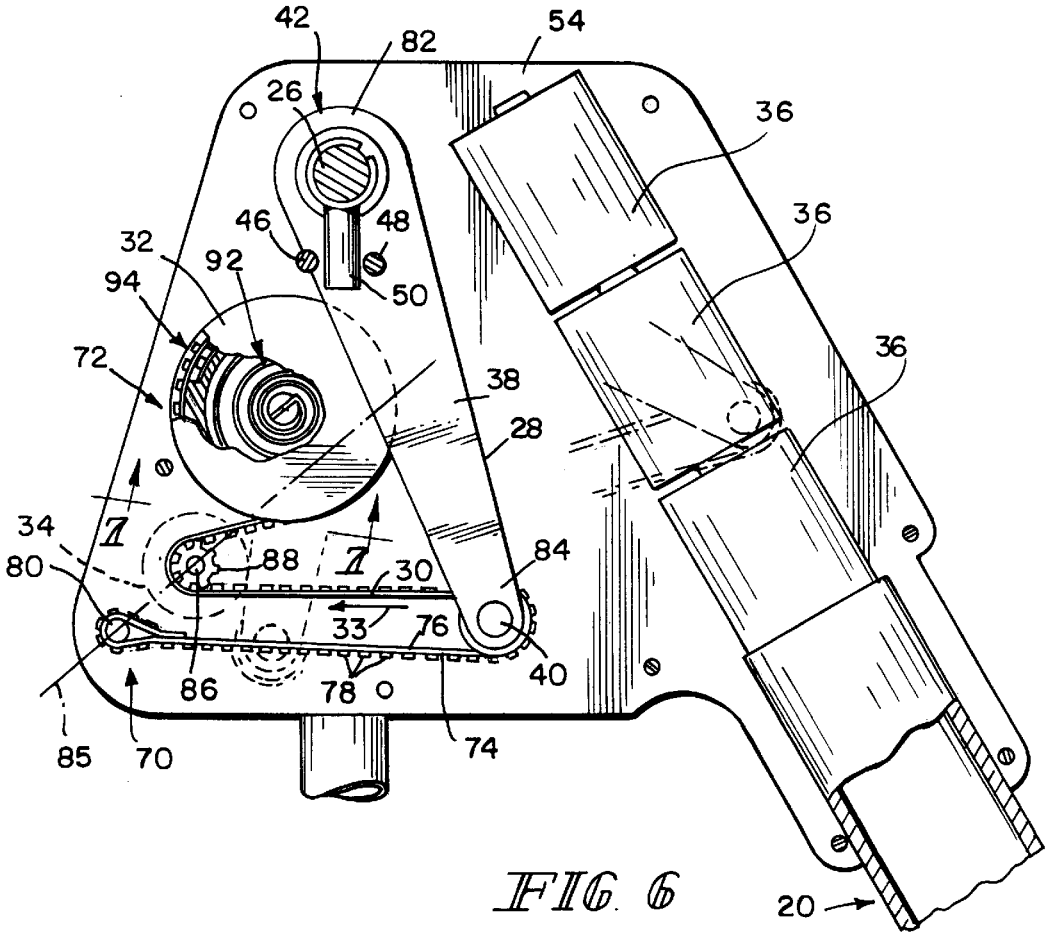
FIG. 6 is a side view taken along line 6—6 of FIG. 3 (in an orientation similar to FIG. 2) showing the drive member, drive belt, and belt tensioner, with a portion of the belt tensioner cut away to show a spring in a partially relaxed state therein.

As shown in FIGS. 2, 3, and 6, swing 14 includes a rotating drive shaft 26 coupled to a drive member 28 and swing driver 16 includes a drive belt 30, a belt tensioner 32, and a belt driver 34. As discussed in more detail below, drive member 28 includes a drive lever 38 and a lever wheel 40. Drive belt 30 is coupled to belt driver 34 and lever wheel 40 to transmit force from belt driver 34 to swing 14. Belt tensioner 32 maintains tension on drive belt 30 as drive shaft 26 and drive member 28 rotate during swinging motion of swing 14, allowing belt driver 34 to impart force to drive belt 30 at any time during swinging movement of swing 14.

The components of swing driver 16 are arranged in a compact manner inside housing 17 as shown in FIGS. 2–9. Belt tensioner 32 is positioned to lie between drive shaft 26 and lever wheel 40 during rotation of the drive member 28. Further, drive member 28 is arranged to pass over a portion of belt tensioner 32 as swing 14 rotates in direction 29 toward a first extreme position (shown in FIG. 9). Swing driver 16 includes batteries 36 for energizing belt driver 34 and drive member 28 is arranged to pass over a portion of batteries 36 as swing 14 rotates in direction 31 toward a second extreme position (shown in FIG. 8).

Swing driver 16 includes a slip switch 42 and a control circuit 44 coupled to slip switch 42 and configured to control actuation of belt driver 34 as shown in FIGS. 3–9. Slip switch 42 and control circuit 44 are the same as those disclosed in application Ser. No. 08/704,277, filed Aug. 28, 1996, now U.S. Pat. No. 5,833,545 the complete disclosure of which is hereby incorporated by reference. Briefly, slip switch 42 includes a switch arm 50 configured to engage an impulse-start contact 46 included in control circuit 44 when swing 14 rotates a predetermined distance 52 away from one extreme position, as shown for example, by dashed lines for swing 14 in FIG. 8. When arm 50 engages start contact 46, control circuit 44 energizes belt driver 34 for a predetermined time. As discussed in more detail below, belt driver 34 then transmits a torque to rotating drive shaft 26 to sustain swinging motion of swing 14. Switch arm 50 stays in contact with start contact 46 until swing 14 reaches a second extreme position as shown, for example, in FIG. 9. Switch arm 50 then engages a timer-reset contact 48 included in control circuit 44 as swing 14 moves from the second extreme position back towards the first extreme position, at which time circuit 44 resets a timer included in control circuit 44. This cycle then repeats starting from the first extreme position.

Figure 4:
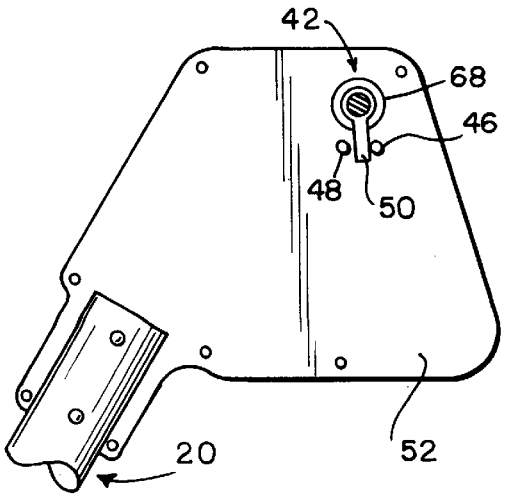
FIG. 4 is side view taken along line 4—4 of FIG. 3 showing the slip switch coupled to an inner side of a housing plate and two spaced-apart contact pins arranged to engage a switch arm of the slip switch during swinging movement of the swing.
Figure 5:
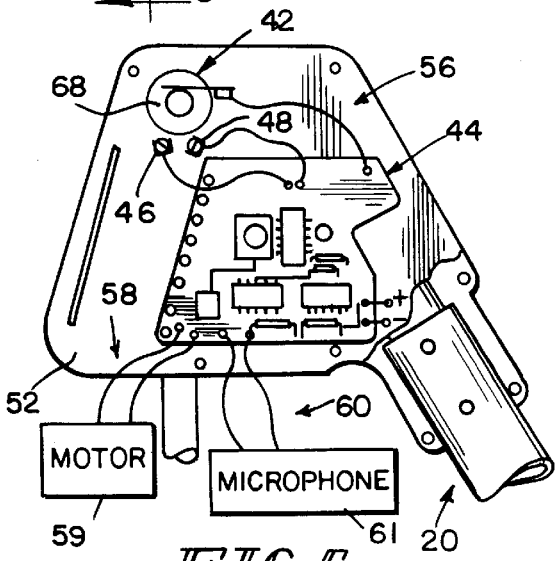
FIG. 5 is a side view taken along line 5—5 of FIG. 3 showing an outer side of the housing plate and showing the control system circuit board coupled to the slip switch, batteries, and external wiring for the motor and an optional microphone.

Drive belt 30, belt tensioner 32, and belt driver 34 are arranged within swing driver 16 in a compact manner to sustain swinging movement of the swing along its swing arc when control circuit 44 energizes belt driver 34. Support stand 12 includes first and second support plates 52, 54 coupled to support arm 20. Control circuit 44 and slip switch impulse-start and timer-reset contacts 46, 48 are mounted to first support plate 52 which in turn is coupled to support arm 20, as shown in FIGS. 3–5. Control circuit 44 includes external wiring 56 coupled to slip switch 42, wiring 58 for coupling to motor 59, and wiring 60 for coupling to an optional microphone 61 that can be used for sound-activation of swing driver 16 (as discussed in application Ser. No. 08/704,277 incorporated by reference above).

Swing 14 includes a drive shaft 62 mounted for rotation on support plates 52, 54 using rotation bearings 64, 66 as best shown in FIG. 3. Drive member 28 and slip switch 42 are each coupled to drive shaft 62 to rotate therewith. Swing seat frame 22 is coupled to drive shaft 62 by a coupling pin 68 for conjoint rotation. Belt tensioner 32 and belt driver 34 are mounted to second support plate 54 in a configuration that allows for drive lever 38 to pass over them as drive lever 38 rotates between first and second extreme positions as shown, for example, in FIGS. 8 and 9.

Figure 8:
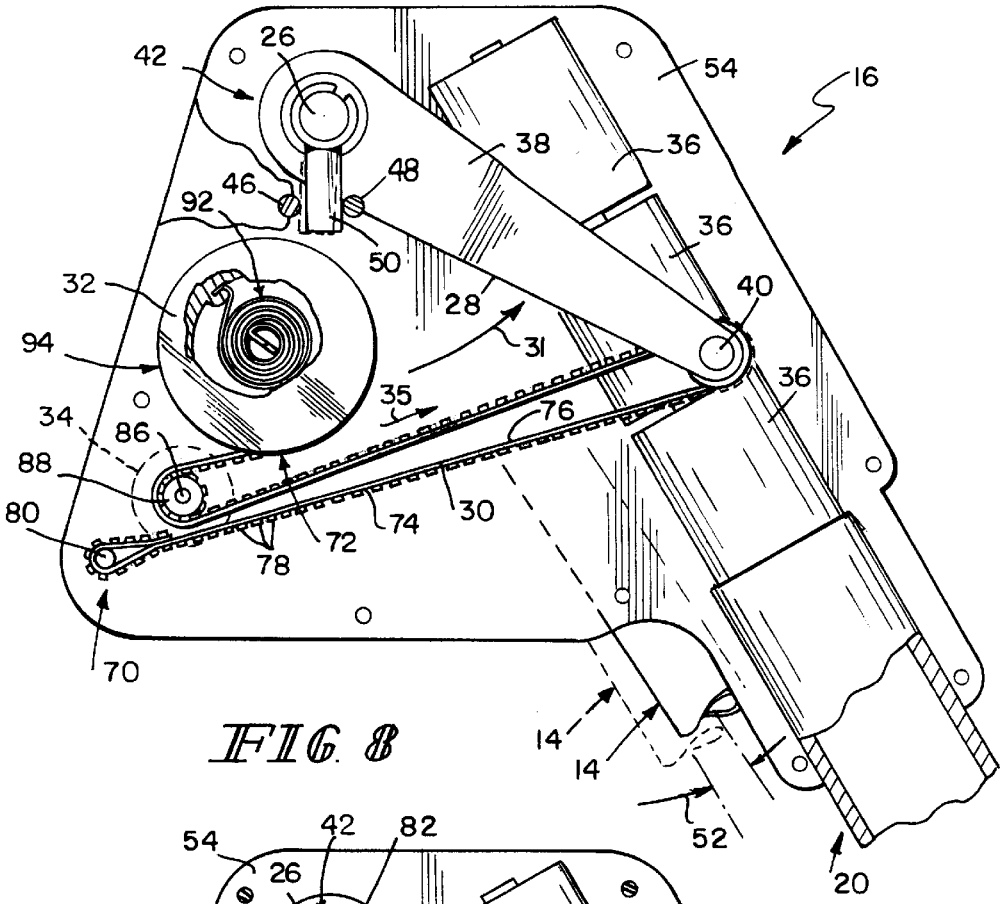
FIG. 8 is a side view similar to FIG. 6 showing the drive member and swing at a first extreme (rearward) position, the slip switch having a switch arm engaging a right-side start contact, and the belt tensioner, with a portion cut away, to show the helical spring in a fully coiled state.
Figure 9:
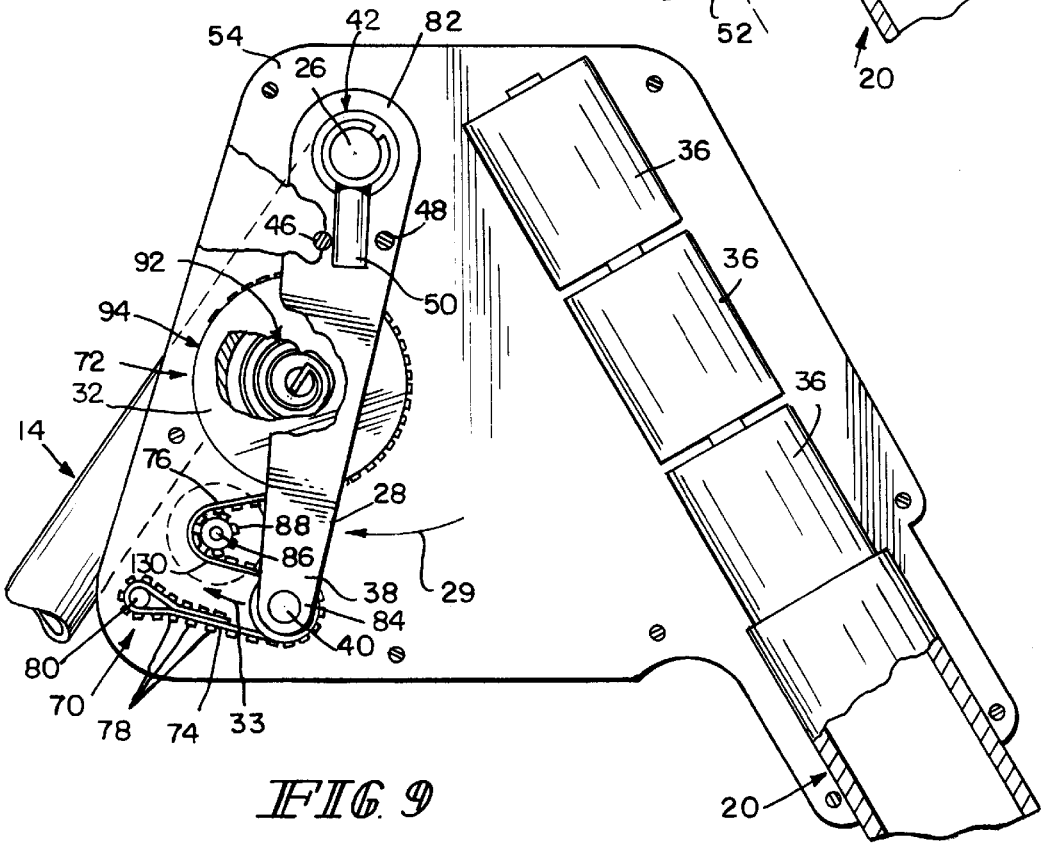
FIG. 9 is a side view similar to FIGS. 6 and 8 showing the drive member and swing at a second extreme (forward) position, the slip switch having a switch arm engaging a left-side reset contact, and the belt tensioner, with a portion cut away, to show the helical spring in a fully relaxed state.

Drive belt 30 is a strap having a fixed end 70, a free end 72, a front side 74, and a back side 76 as shown, for example, in FIGS. 6, 8, and 9. Drive belt 30 includes a plurality of drive teeth 78 appended to front side 74. Drive belt 30 can be formed in any suitable manner from any suitable material. Support plate 54 includes an anchor pin 80 and fixed end 70 of drive belt 30 is coupled to anchor pin 80. Fixed end 70 is coupled to anchor pin 80 by a loop that encircles pin 80, although it is within the scope of this disclosure to use any suitable coupling mechanism to secure fixed end 70 relative to support stand 12, such as a clip, hook, clamp, or other retaining element. Free end 72 of drive belt 30 is coupled to belt tensioner 32 so that drive belt 30 remains in tension throughout movement of swing 14 between first and second extreme positions.

Drive lever 38 includes a base end 82 coupled to drive shaft 26 and a free end 84 spaced apart from base end 82. Drive member 28 includes lever wheel 40 mountedfor rotation about an axis on free end 84 of drive lever 38. Back side 76 of drive belt 30 is wrapped around lever wheel 40 so that lever wheel 40 rotates as belt tensioner 32 moves drive belt 30. Although back side 76 of drive belt 30 provides a toothless friction surface, it is within the scope of this disclosure for back side 76 to carry teeth similar to front side 74, in which case lever wheel 40 could be a rotating gear. Furthermore, although drive belt 30 wraps around lever wheel 40, fixed end 70 of drive belt 30 alternatively can be coupled directly to free end 84 of drive lever 38 instead of lever wheel 40.

Belt driver 34 is an electric motor powered by four 1.5 volt batteries 36 that also provide electrical power for control circuit 44. Belt driver 34 includes a motor output shaft 86 that rotates freely when power is off to belt driver 34 and that imparts a force to drive belt 30 when energized. Belt driver 34 further includes a drive gear 88 carried on the output shaft 86 for conjoint rotation. Front side 74 of drive belt 30 is wrapped around drive gear 88 so that gear 88 engages teeth 78 to improve the ability of belt driver 34 to impart force to swing 14. Although a toothless friction surface can be used to couple drive belt 30 to belt driver 34, use of drive gear 88 engaging teeth 78 reduces slippage to increase efficiency in transferring power between belt driver 34 and drive belt 30. Thus, output shaft 86 and drive gear 88 together provide an efficient drive assembly that couples belt driver 34 to drive belt 30.

The center points of output shaft 86 and anchor pin 80 define between them an imaginary reference line 85 as shown in FIG. 6. Swing driver 16 is arranged so that rotating drive shaft 26 is positioned to lie on one side of reference line 85 while lever wheel 40 of drive member 28 is positioned to lie on the other side of line 85. Anchor pin 80 could be relocated so that both shaft 26 and wheel 40 would be positioned on the same side of an imaginary line intersecting the center points of shaft 26 and pin 80.

Figure 7:
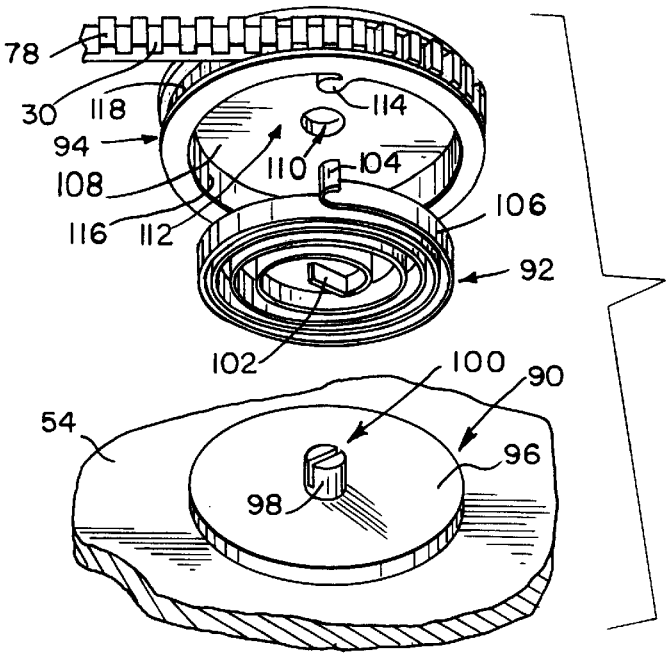
FIG. 7 is an exploded perspective view of the belt tensioner of FIG. 6 taken along line 7—7 showing a wheel mount formed to include a post-receiving aperture, a wheel coupled to a circular outer edge of the wheel mount and to the drive belt, a drive lug appended to the wheel mount, a support base including a disk-type foundation and a post mounted on the foundation and configured to enter the post-receiving aperture and formed to include an anchor slot, and a helical spring having a drive tang adapted to engage the drive lug and an anchor tang adapted to enter the anchor slot formed in the post.

Belt tensioner 32 includes a support base 90, a constant-force spring 92, and a spring wheel 94 as best shown in FIG. 7. Belt tensioner 32 uses constant-force spring 92 to spin spring wheel 94 to take up slack in drive belt 30 as free end 84 of drive lever 38 rotates towards anchor pin 80 so that when belt driver 34 is energized, swing driver 16 can immediately and efficiently transfer force from belt driver 34 to swing 14 to maintain swinging motion of swing 14.

Support base 90 includes a disk-shaped foundation 96 and an anchor post 98 having an anchor slot 100. Constant-force spring 92 includes an inner, fixed end or anchor tang 102, an outer, free end or drive tang 104, and a spiral member 106 coupled between anchor tang 102 and drive tang 104. Anchor tang 102 is configured to be received in a slot 100 formed in anchor post 98.

Spring wheel 94 is coupled to a wheel mount 108 that includes a post-receiving aperture 110. Spring wheel 94 and wheel mount 108 cooperate to define a spring cavity 112 configured to receive constant-force spring 92. Spring wheel 94 further includes a drive lug 114 appended to an inner surface 116 to engage drive tang 104 of constant-force spring 92. Spring wheel 94 furthermore includes an outer surface 118 coupled to drive belt 30 so that spring wheel 94 and support base 90 provide a rotatable belt support that allows drive belt 30 to wrap or unwrap around wheel 94 as it rotates about anchor post 98. As spring wheel 94 rotates, spiral member 106 winds or unwinds around anchor post 98 to provide force as needed to keep drive belt 30 in tension. Belt tensioner 32 thus provides a compact arrangement that secures its constant-force spring 92 within an assembly that can be coupled readily to drive belt 30 and mounted conveniently on support plate 54 while providing protection for the spring 92. Furthermore, in order to reduce the size requirements for swing driver 16, belt tensioner 32 is positioned to lie in a space between drive shaft 26 and belt driver 34, although it is within the scope of this disclosure to position belt tensioner 32 in other locations.

Swing driver 16 operates in the following manner. As swing 14 swings, belt tensioner 32 operates to urge drive belt 30 in a first direction along a path established by drive belt 30 as it is coupled to belt tensioner 32, belt driver 34, drive member 28, and anchor pin 80. As drive member 28 moves away from a second extreme position as shown in FIG. 9 to a first extreme position as shown in FIG. 8, drive belt 30 moves in a second direction 35 opposite to first direction 33. As drive member 28 moves from the first extreme position to the second extreme position, belt tensioner 32 maintains tension on drive belt 30 and belt driver operates to move drive belt 30 in first direction 33 along the path opposite to the second direction 35. Drive belt 30 thus applies force to drive member 28, which in turn applies a torque to drive shaft 26. Swing driver 16 thus provides a compact and efficient mechanism to sustain swinging movement of swing 14 relative to support stand 12 along the swing arc.

Figure 10:
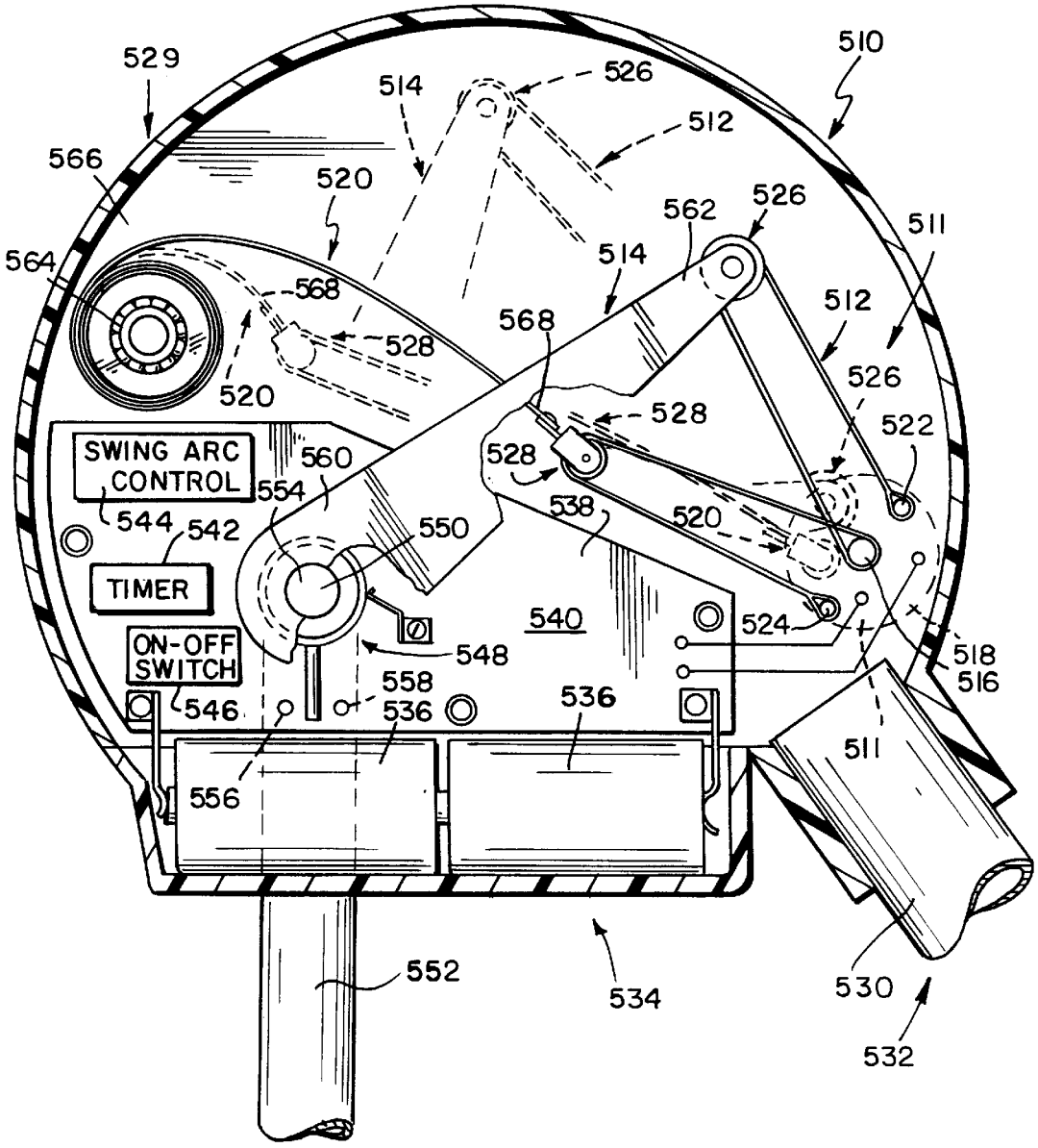
FIG. 10 is side view similar to FIG. 6 of a portion of a swing in accordance with another embodiment of the present invention showing an alternative swing drive system including a somewhat round housing coupled to a support stand, a control circuit, batteries, an electric motor, a drive belt coupled to a drive member for imparting a torque to a swing seat frame, a belt tensioner including a spring assembly and a pulley, and a slip switch having a switch arm and start and reset contacts.
Figure 11:
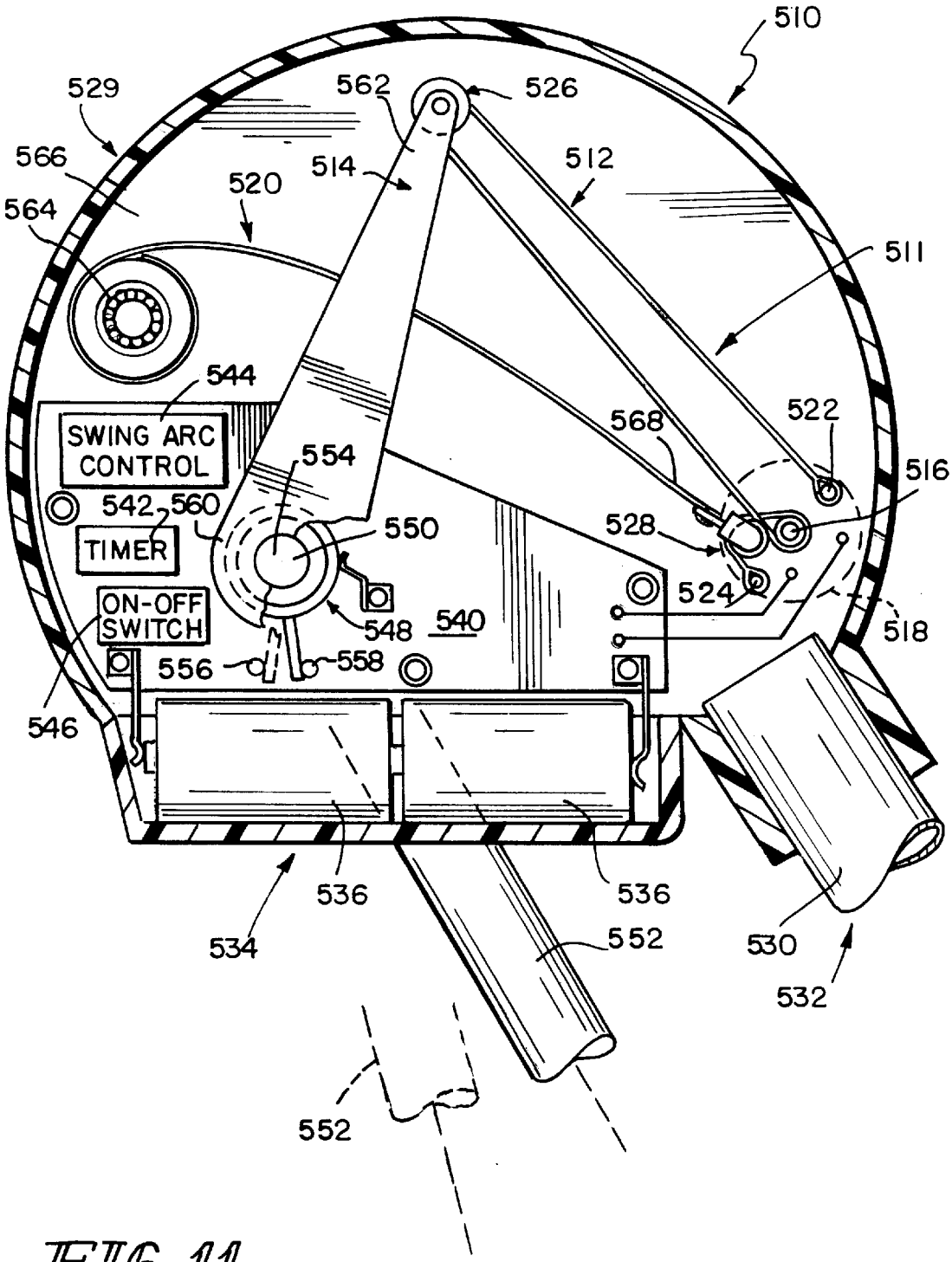
FIG. 11 is a view similar to FIG. 10 showing the swing frame and drive member at a first extreme (rearward) position, the switch arm of the slip switch at a rearward position engaging a start contact, and the spring assembly in a coiled state.
Figure 12:
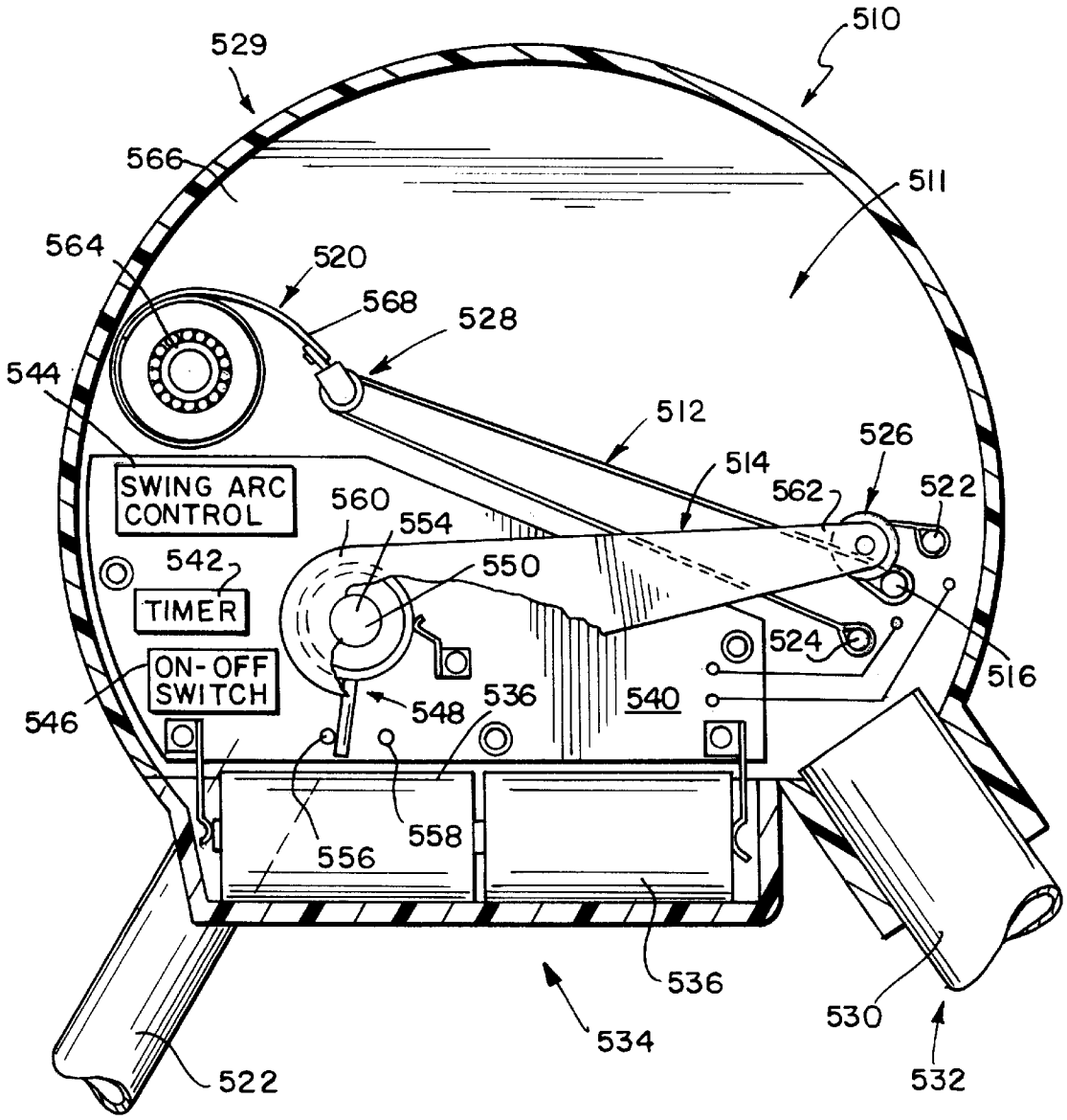
FIG. 12 is a view similar to FIGS. 10 and 11 showing the swing frame and drive member at a second extreme (forward) position, the switch arm of the slip switch at a forward position engaging a reset contact, and the spring assembly in a relaxed state.

Another embodiment of a pendulum-drive system 510 in accordance with the present invention is shown in FIGS. 10–12. Pendulum-drive system 510 is also well-suited for use in the embodiment shown, for example, in FIGS. 1 and 2. A line-control system 511 controls location and movement of a drive line 512 coupled to drive lever 514, motor shaft 516 of electric motor 518, and line-tensioning spring 520 to provide a compact design for pendulum-drive system 510. Illustratively, line-control system 511 includes a pair of anchor posts 522, 524 adjacent to motor shaft 516, one pulley 526 mounted on drive lever 514, and another pulley 528 mounted on line-tensioning spring 520.

Pendulum-drive system 510 includes a compact housing 529 mounted on a support leg 530 included in a support stand 532 similar to stand 12 shown in FIG. 1. Compact housing 529 would be used in place of housing 17 shown in the embodiment of FIG. 1 to contain various components included in pendulum-drive system 510.

Pendulum-drive system 510 also includes a battery pack 534 including four "D" cells 536, a circuit board 538 carrying an electrical circuit 540 including a timer 542, a swing arc control 544, and an on-off switch 546. A suitable circuit is described in parent application Ser. No. 08/704,277 and is incorporated by reference herein.

A slip switch 548 is included in pendulum-drive system 510 and mounted on a drive shaft 550 arranged to extend into compact housing 529 and connect to right-side hanger arm 552. Drive shaft 550 is rotatable about axis 554. Slip switch 548 is coupled to an electrical wiper contact 549 and is movable to engage impulse-start contact 556 and timer-reset contact 558 during swinging movement of hanger arm 552. Slip switch 548 operates in the same manner as slip switch 42 (described above) so that, in use, electrical engagement of slip switch 548 and impulse-start contact 556 starts motor timer 542 which in turn starts electric motor 518 when hanger arm has rotated through an angle 553 from the first extreme position toward the second extreme position as shown in FIG. 11. Then, power to the electric motor 518 is turned off by motor timer 542 during swinging movement of hanger arm 552 in one direction. Then motor timer 542 is reset due to electrical engagement of slip witch 548 and timer-reset contact 558 during swinging movement of hanger arm 552 in an opposite direction. As was the case in the embodiment of FIGS. 1–9, motor 518 is actuated and allowed to run for a predetermined time interval to apply an angular impulse to the swing seat frame and seat once during each swing cycle.

Drive lever 514 includes a base end 560 coupled to drive shaft 550 and a free end 562 carrying pulley 526. Line-tensioning spring 520 is illustratively a single constant-force (negator) spring mounted on a bearing 564 fixed to a panel 566 included in compact housing 529. Spring 520 includes a free end 568 carrying pulley 528.

Drive line 512 includes one end 570 coupled to first anchor post 522 (mounted on panel 566) and another end 572 coupled to second anchor post 524 (mounted on panel 566). Drive line 512 also includes a middle portion that is wrapped around pulley 526 on drive lever 514, motor shaft 516, and pulley 528 on line-tensioning spring 520 as shown in FIG. 10. Drive lever 514 is able to pivot from one extreme position wherein pulley 526 is far away from drive shaft 516 as shown in FIG. 11 (and by dashed lines in FIG. 10) to another extreme position wherein pulley 526 is close to drive shaft 516 as shown in FIG. 12 (and by dashed lines in FIG. 10). In use, drive lever 514 pivots about axis 554 due to force applied by drive line 512 during rotation of motor shaft 516.

In the embodiment of FIGS. 10–12, a high torque is generated in a small package. By attaching the drive line 512 to post 522 and over pulley 526, a 2:1 ratio is established as twice as much line is used. Pulley 528 is coupled to line-tensioning spring 520 to use up extra line with a 1:2 ratio (otherwise the spring would extend twice as far requiring a larger size housing). This arrangement causes the spring force to be divided by two.

Although the invention has been described in detail with reference to certain embodiments, variations and modifications exist within the scope and spirit of the present invention as described and defined in the following claims.

I claim:

1. A swing assembly comprising a support stand, a swing mounted on the support stand to swing back and forth along a swing arc, and a swing driver including a drive belt coupled to the swing, a belt tensioner coupled to the drive belt to place the drive belt in tension, and a belt driver coupled to the drive belt to move the drive belt relative to the support stand while the drive belt remains in tension to apply force to the swing to sustain swinging movement of the swing along the swing arc, the drive belt including a strap having a fixed end coupled to the support stand and a free end coupled to the belt tensioner and drive teeth appended to the strap and coupled to the belt driver.

2. The swing assembly of claim 1, wherein the swing includes a drive shaft mounted for rotation on the support stand, a swing seat frame coupled to the drive shaft for rotation therewith, and a drive member coupled to the drive shaft for rotation therewith, and the drive belt is coupled to the drive member.

3. The swing assembly of claim 2, wherein the drive member includes a drive lever having a base end coupled to the drive shaft and a free end arranged to lie in spaced-apart relation to the base end and a lever wheel mounted on the free end for rotation about an axis of rotation and the drive belt wraps around a portion of the lever wheel.

4. The swing assembly of claim 3, wherein the strap has a first side carrying the drive teeth and a second side providing a friction surface engaging the lever wheel.

5. The swing assembly of claim 3, wherein the belt driver includes an electric motor, a motor shaft turned by the electric motor, and a drive gear carried on the motor shaft for rotation therewith, and the strap has a first side carrying the drive teeth and engaging the drive gear and a second side providing a friction surface engaging the lever wheel.

6. The swing assembly of claim 3, wherein the belt tensioner is positioned to lie between the drive shaft and the lever wheel during rotation of the drive member about the axis of rotation.

7. The swing assembly of claim 3, wherein the support stand includes a drive base and an anchor pin appended to the drive base and coupled to the fixed end of the strap, the belt driver includes an electric motor and a drive apparatus turned by the electric motor and arranged to engage the drive teeth of the drive belt, a reference line intersects the anchor pin and the drive apparatus, and the drive shaft is positioned to lie on one side of the reference line and the lever wheel is positioned to lie on another side of the reference line during rotation of the drive lever about the axis of rotation.

8. The swing assembly of claim 2, wherein the strap has a first side carrying the drive teeth and engaging the belt driver and a second side providing a friction surface engaging the drive member.

9. The swing assembly of claim 8, wherein the belt driver includes an electric motor, a motor shaft turned by the electric motor, and a drive gear carried on the motor shaft for rotation therewith and arranged to engage the drive teeth on the first side of the strap.

10. The swing assembly of claim 8, wherein the drive member includes a drive lever coupled to the drive shaft and a lever wheel mounted on the drive lever for rotation about an axis of rotation and arranged to engage the friction surface on the second side of the strap.

11. The swing assembly of claim 1, wherein the belt tensioner includes a belt support including a support base and a spring wheel rotatable about an axis of rotation relative to the support base and a constant-force spring acting between the support base and the spring wheel and the free end of the drive belt is coupled to the spring wheel to rotate therewith about the axis of rotation.

12. The swing assembly of claim 11, wherein the spring wheel includes an outer wall engaging the drive belt and an inner wall defining a spring cavity and the constant-force spring is positioned to lie in the spring cavity.

13. The swing assembly of claim 12, wherein the strap has a first side carrying the drive teeth and a second side providing a friction surface engaging the outer wall of the spring wheel.

14. The swing assembly of claim 12, wherein the constant-force spring includes a fixed end coupled to the support base and a free end coupled to the inner wall of the spring wheel.

15. The swing assembly of claim 1, wherein the belt tensioner includes a rotatable spring wheel and a constant-force spring coupled to the rotatable spring wheel, the belt driver includes a rotatable toothed drive apparatus and an electric motor configured to turn the rotatable toothed drive apparatus, the swing includes a drive shaft mounted for rotation on the support stand, a swing seat frame coupled to the drive shaft for rotation therewith, a drive lever coupled to the drive shaft for rotation therewith, and a rotatable lever wheel mounted for rotation on the drive lever, and the strap includes a first side carrying the drive teeth and engaging the rotatable toothed drive apparatus and a second side providing a friction surface engaging the rotatable spring wheel and lever wheel.

16. The swing assembly of claim 15, wherein the belt tensioner is positioned to lie between the drive shaft and the lever wheel during rotation of the drive lever.

17. The swing assembly of claim 16, wherein the drive lever has a base end coupled to the drive shaft and a free end arranged to lie in spaced-apart relation to the base end and the lever wheel is mounted on the free end for rotation about an axis of rotation.

18. The swing assembly of claim 1, wherein the support stand includes a frame coupled to the swing and a drive base coupled to the frame, the belt driver includes an electric motor, motor-energizer batteries mounted on the drive base and coupled to energize the electric motor, and a rotatable toothed drive apparatus turned by the electric motor, and the drive member includes a drive lever coupled to the drive shaft to rotate therewith and arranged to pass over a portion of the belt tensioner to reach a first limit position during movement of the swing in a first direction along the swing arc and to pass over a portion of the motor-energizer batteries to reach a second limit position during movement of the swing in a second direction along the swing arc.

19. The swing assembly of claim 18, wherein the drive member further includes a lever wheel mounted on the drive lever for rotation about an axis of rotation and arranged to engage the friction surface on the second side of the strap during movement of the drive lever between the first and second limit positions.

20. A swing assembly comprising a support stand, a swing mounted on the support stand to swing back and forth along a swing arc, and a swing driver including a drive belt coupled to the swing, a belt tensioner coupled to the drive belt to place the drive belt in tension, and a belt driver coupled to the drive belt to move the drive belt relative to the support stand while the drive belt remains in tension to apply force to the swing to sustain swinging movement of the swing along the swing arc, the belt tensioner including a rotatable belt support mounted for rotation about an axis of rotation and a constant-force spring coupled to the rotatable belt support and the support stand.

21. The swing assembly of claim 20, wherein the rotatable belt support includes a spring wheel rotatable about the axis of rotation and the drive belt wraps about a portion of the spring wheel.

22. The swing assembly of claim 21, wherein the spring wheel includes an annular outer wall engaging the drive belt and an inner wall defining a spring cavity receiving the constant-force spring therein.

23. The swing assembly of claim 22, wherein the spring wheel further includes a drive lug appended to the inner wall and coupled to a free end of the constant-force spring.

24. The swing assembly of claim 22, wherein the rotatable belt support further includes a post coupled to the support stand and a wheel mount appended to the spring wheel to define a boundary of the spring cavity and formed to include an aperture receiving the post therein to establish the axis of rotation.

25. The swing assembly of claim 22, wherein the rotatable belt support further includes a post coupled to the support stand and formed to include a slot, the spring wheel further includes a drive lug appended to the inner wall, and the constant-force spring includes a fixed end engaged in the slot, a free end coupled to the drive lug, and a spiral member appended to the fixed and free ends and arranged to wind around the post.

26. The swing assembly of claim 21, wherein the rotatable belt support further includes a post coupled to the support stand and a wheel mount appended to the spring wheel and formed to include an aperture receiving the post therein to establish the axis of rotation.

27. The swing assembly of claim 26, wherein the constant-force spring includes a free end coupled to the spring wheel, a fixed end coupled to the post, and a spiral member appended to the fixed and free ends and arranged to wind around the post.

28. The swing assembly of claim 26, wherein the post is formed to include a slot and an end of the constant-force spring is engaged in the slot.

29. The swing assembly of claim 20, wherein the constant-force spring is positioned to lie in an interior region formed in the rotatable belt support and the drive belt wraps around a portion of the rotatable belt support.

30. The swing assembly of claim 20, wherein the belt driver includes an electric motor, the swing includes a drive shaft mounted for rotation on the support stand and a swing seat frame coupled to the drive shaft for rotation therewith, and the constant-force spring is positioned to lie in a space between the electric motor and the drive shaft.

31. The swing assembly of claim 30, wherein the rotatable belt support is positioned to lie in the space between the electric motor and the drive shaft.

32. The swing assembly of claim 31, wherein the constant-force spring is positioned to lie in an interior region formed in the rotatable belt support and the drive belt wraps around a portion of the rotatable belt support.

33. A swing assembly comprising a support stand, a swing mounted on the support stand to swing back and forth along a swing arc, the swing including a drive shaft mounted for rotation on the support stand, a swing seat frame coupled to the drive shaft for rotation therewith about an axis of rotation, and a drive member coupled to the drive shaft for rotation therewith about the axis of rotation, a drive belt coupled to the drive member for movement in a first direction during clockwise rotation of the drive member and a second direction opposite the first direction during counter-clockwise rotation of the drive member, a belt tensioner coupled to the drive belt to urge the drive belt in the first direction to maintain the drive belt in tension, and a belt driver coupled to the drive belt to move the drive belt relative to the support stand in the first direction while the drive belt remains in tension to apply force to the drive member and torque to the drive shaft to sustain swinging movement of the swing seat frame relative to the support stand along the swing arc, the belt tensioner being positioned to lie in a space between the drive shaft and the belt driver.

34. The swing assembly of claim 33, wherein the drive member includes a drive lever having a base end coupled to the drive shaft and a free end arranged to lie in spaced-apart relation to the base end and a lever wheel mounted on the free end for rotation about an axis of rotation and the drive belt wraps around a portion of the lever wheel.

35. The swing assembly of claim 34, wherein the drive belt includes a fixed end coupled to the support stand and a free end coupled to the belt tensioner, and the belt driver includes an electric motor and drive apparatus turned by the electric motor and coupled to the drive belt.

36. The swing assembly of claim 33, wherein the belt tensioner includes a belt support including a support base and a spring wheel rotatable about an axis of rotation relative to the support base and a constant-force spring acting between the support base and the spring wheel and the free end of the drive belt is coupled to the spring wheel to rotate therewith about the axis of rotation.

37. The swing assembly of claim 36, wherein the spring wheel includes an outer wall engaging the drive belt and an inner wall defining a spring cavity and the constant-force spring is positioned to lie in the spring cavity.

38. The swing assembly of claim 37, wherein the constant-force spring includes a fixed end coupled to the support base and a free end coupled to the inner wall of the spring wheel.

39. The swing assembly of claim 33, wherein the support stand includes a frame coupled to the swing and a drive base coupled to the frame, the belt driver includes an electric motor, motor-energizer batteries mounted on the drive base and coupled to energize the electric motor, and a rotatable toothed drive apparatus turned by the electric motor, and the drive member includes a drive lever coupled to the drive shaft to rotate therewith and arranged to pass over a portion of the belt tensioner to reach a first limit position during movement of the swing in the first direction along the swing arc and to pass over a portion of the motor-energizer batteries to reach a second limit position during movement of the swing in the second direction along the swing arc.

40. A swing assembly comprising a support stand, a swing mounted on the support stand to swing back and forth along a swing arc, the swing including a drive shaft mounted for rotation on the support stand, a swing seat frame coupled to the drive shaft for rotation therewith about an axis of rotation, and a drive member coupled to the drive shaft for rotation therewith about the axis of rotation, and a swing driver including a drive belt having first and second fixed ends coupled to the swing, a belt tensioner coupled to the drive belt to place the drive belt in tension, and a belt driver coupled to the drive belt to move the drive belt relative to the support stand while the drive belt remains in tension to apply force to the swing to sustain swinging movement of the swing along the swing arc, the belt tensioner including a pulley coupled to the drive belt and a constant-force spring coupled to the pulley and the support stand.

41. The swing assembly of claim 40, wherein the drive member includes a drive lever coupled to the drive shaft and a lever wheel mounted on the drive lever for rotation about an axis of rotation and arranged to engage the drive belt.

42. The swing assembly of claim 40, wherein the drive lever is arranged to pass over the pulley of the belt tensioner during movement of the swing.

* * * * *